US005425658A

United States Patent [19]

White

[11] Patent Number: 5,425,658

[45] Date of Patent: Jun. 20, 1995

[54] CARD EDGE CONNECTOR WITH REDUCED CONTACT PITCH

[75] Inventor: Robert C. White, Cliffside Park, N.J.

[73] Assignee: Burndy Corporation, Norwalk, Conn.

[21] Appl. No.: 145,418

[22] Filed: Oct. 29, 1993

[51] Int. Cl.[6] ..... H01R 23/70

[52] U.S. Cl. ..... 439/637; 439/60

[58] Field of Search ..... 439/60, 637

[56] References Cited

U.S. PATENT DOCUMENTS

| | | | |
|---|---|---|---|
| 4,030,792 | 6/1977 | Fuerst | 339/17 LC |
| 4,846,734 | 7/1989 | Lytle | 439/637 |
| 4,891,023 | 1/1990 | Lopata | 439/637 |
| 4,894,022 | 1/1990 | Guckenheimer | 439/260 |
| 5,026,292 | 6/1991 | Pickles et al. | 439/108 |
| 5,112,231 | 5/1992 | Harwath et al. | 439/60 |

*Primary Examiner*—Z. R. Bilinsky

*Attorney, Agent, or Firm*—Perman & Green

[57] ABSTRACT

A card edge connector with a housing and electrical contacts. The electrical contacts are spaced from adjacent contacts at a center-to-center pitch of 0.025 inch. The contacts each have a middle section that is interference fit in a contact receiving channel of the housing. The middle sections each have a general ring shape with a center electromagnetic reduction aperture. The ring shape forms a structural truss to retain structural rigidity of the middle section to enable the interference fit to be made and, the center electromagnetic reduction aperture reduces capacitance between the closely spaced adjacent contacts.

16 Claims, 2 Drawing Sheets

CARD EDGE CONNECTOR WITH REDUCED CONTACT PITCH

BACKGROUND OF THE INVENTION

1. Field of the Invention

The present invention relates to electrical connectors and, more particularly, to card edge connectors.

2. Prior Art

The art is replete with patents regarding card edge connectors. Examples can be found in the following U.S. Pat. Nos.: 4,891,023; 4,894,022; 5,026,292; 4,030,792; and 4,846,734. There is a seemingly ever-present need for reducing the size of card edge connectors to minimize the amount of space used by such connectors on mother printed circuit boards. Present card edge connectors only space contacts at a center-to-center pitch or spacing of about 0.050 inch because of electromagnetic problems and manufacturability problems that arise if the present types of contacts are attempted to be moved closer together.

SUMMARY OF THE INVENTION

In accordance with one embodiment of the present invention a card edge connector is provided comprising a housing and electrical contacts connected to the housing. The housing has a card edge receiving area and two rows of contact receiving channels on opposite sides of the card edge receiving area. The contacts are located in the contact receiving channels. Each contact has a top spring arm, a bottom solder tail, and a middle section therebetween. Each of the middle sections has a general ring-shape with a center aperture and two opposite sides making an interference fit with the housing in one of the receiving channels.

In accordance with another embodiment of the present invention in a card edge connector having a housing and electrical contacts, each of the contacts having a cantilevered spring arm for contacting an edge of a daughter printed circuit board, a solder tail for contacting a mother printed circuit board, and a middle section between the spring arm and solder tail, the middle section forming an interference fit with the housing, the improvement comprising the middle sections of the contacts each having a relatively large electromagnetic reduction aperture in their centers to form a general ring-shape, wherein the general ring shape allows the middle section to have sufficient structural rigidity to form the interference fit with the housing and, also reduces the amount of material in the middle section to reduce capacitance between adjacent contacts.

In accordance with another embodiment of the present invention a card edge connector is provided comprising a housing having a card edge receiving area, and electrical contacts connected to the housing. The contacts have a middle section with two opposite side walls forming an interference bit with the housing and an electromagnetic reduction aperture between the two walls. The middle section has a general structural truss shape to retain structural rigidity between the two walls, but also allow the aperture to be substantially large.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
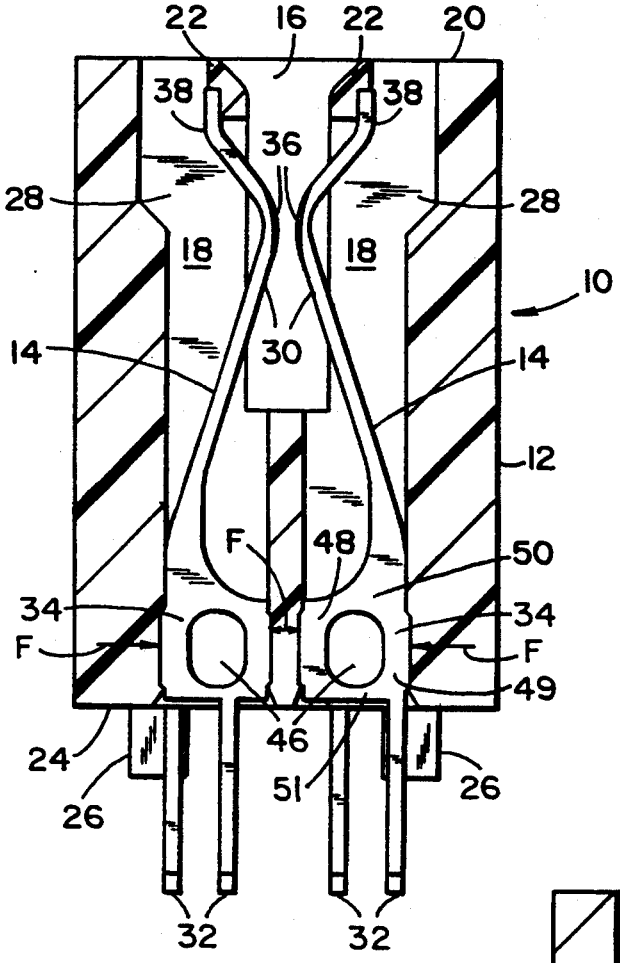
FIG. 1 is a cross sectional view of a card edge connector incorporating features of the present invention.

Referring to FIG. 1, there is shown a cross sectional view of a card edge connector 10 incorporating features of the present invention. Although the present invention will be described with reference to the embodiments shown in the drawings, it should be understood that the present invention can be embodied in various different forms of embodiments. Features of the present invention may be incorporated into types of electrical connectors other than card edge connectors. In addition, any suitable size, shape, or type of elements or materials could be used.

Figure 3:
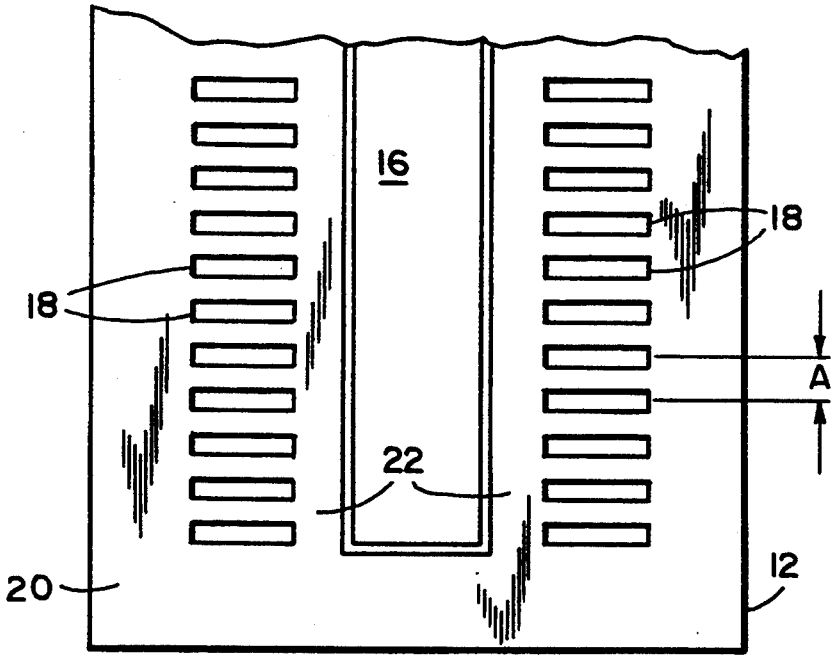
FIG. 3 is a top plan view of one end of the housing of the connector shown in FIG. 1.

The connector 10 generally comprises a housing 12 and electrical contacts 14. The housing 12 is made of a dielectric material, such as a molded polymer or plastic material. The housing 12 includes a card edge receiving area 16 and two rows of contact receiving channels 18 on opposite sides of the receiving area 16. The channels 18 have a center-to-center spacing between adjacent channels, as shown by A in FIG. 3, of about 0.025 inch. In alternate embodiments, the spacing A may be more or less than 0.025 inch. The top 20 of the housing 12 has preload sections 22. The bottom 24 of the housing 12 has standoffs 26. Walls 28 separate adjacent channels 18 from each other. The channels 18 all open into the receiving area 16.

Figure 4:
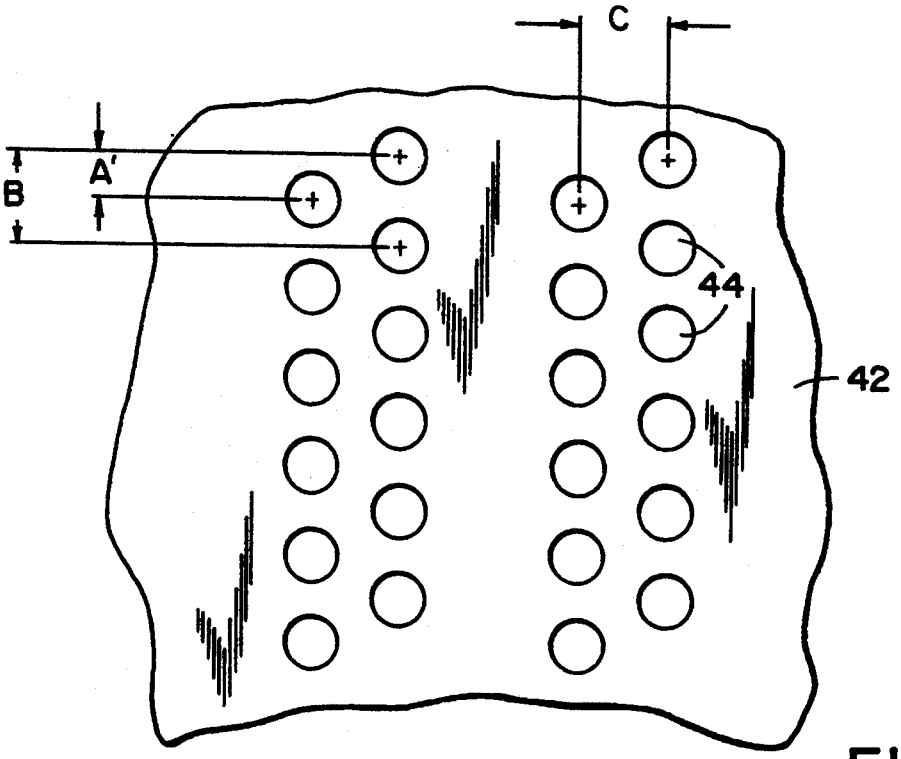
FIG. 4 is a partial plan top view of a mother printed circuit board adapted to have the connector shown in FIG. 1 connected thereto.

The contacts 14 are comprised of flat sheet metal that is cut into the shapes shown. In the embodiment shown, the contacts 14 each comprise a top spring arm 30, a bottom solder tail 32, and a middle section 34 between the spring arm 30 and solder tail 32. The spring arm 30 has a contact area 36 for contacting a contact pad on an inserted daughter printed circuit board. Contact areas 36 are coined to exert increased pressure against the contact pads. Preload tabs 38 are preloaded against preload sections 22. The bottom of the arms 30 have an enlarged section 40 at its connection with the middle section 34 for increased strength. The shape of the enlarged section 40 is designed to obtain the necessary amount of deflection without failure of the spring arm 30 when a daughter board is inserted in the receiving area 16 while also minimizing the amount of material used for the enlarged section 40. The solder tails 32 are through-hole mounted to the mother board 42 (see FIG. 4). As seen in FIG. 4, the mother board 42 has holes 44 that the solder tails 32 are located in. In the embodiment shown, the holes 44 are arranged in two groups of two staggered rows each. The spacing A' matches the spacing A of the contact receiving channels; 0.025 inch in the embodiment shown. The spacing B in the embodiment shown, is 0.050 inch. The spacing C, in the embodiment shown, is 0.050 inch. The holes 44 have a diameter of 0.030 inch. In alternate embodiments, other spacings could be provided. The solder tails 32 of adjacent contacts in each row are staggered to match the staggered pattern of holes 44 in the mother board 42.

Referring now primarily to FIG. 1, the middle sections 34 of each contact 14 has a general ring shape with a center aperture 46. The aperture 46 is relatively large such that the middle section 34 forms a structural truss shape with two side wall sections 48, 49 and two connecting beam sections 50, 51. The middle section 34 performs the function of fixedly mounting the contact 14 to the housing 12. This is accomplished by an interference fit between the middle section 34 and the housing 12 inside the channel 18. When the contacts 14 are pressed into the channels 18 through the bottom 24 of the housing 12, the side wall sections 48, 49 engage opposite side walls of the housing 12 inside its channel 18 to form the interference fit. The housing 12 exerts a force F against the side wall sections 48, 49 of each contact. The two connecting beam sections 50, 51 retain the structural rigidity of the middle section 34. This allows the two side sections 48, 49 to perform their function of forming the interference fit with the housing without the middle sections 34 collapsing from the force F.

The center aperture 46 is provided for electromagnetic interference reduction between adjacent contacts in each row. In particular, because the contacts 14 are so close together, a center-to-center spacing of about 0.025 inch, and electricity traveling through the contacts emanates electromagnetic energy, false or distorted signals could occur in adjacent contacts. In particular, capacitance is a problem with closely spaced contacts. The present invention uses the aperture 46 to minimize the amount of material in the middle section 34 to thereby minimize electromagnetic energy interference and capacitance between adjacent contacts. The shape of the middle section 34 has been developed to allow the staggered arrangement of solder tails 32, to form the interference fit mounting with the housing, to minimize capacitance between adjacent contacts, and to allow cost effective flat sheet metal to be used to form the contacts. The reduced potential for capacitance allows the contacts to be spaced closer together. This reduces the size of the connector and takes up less area on the mother board than presently available connectors.

Figure 2:
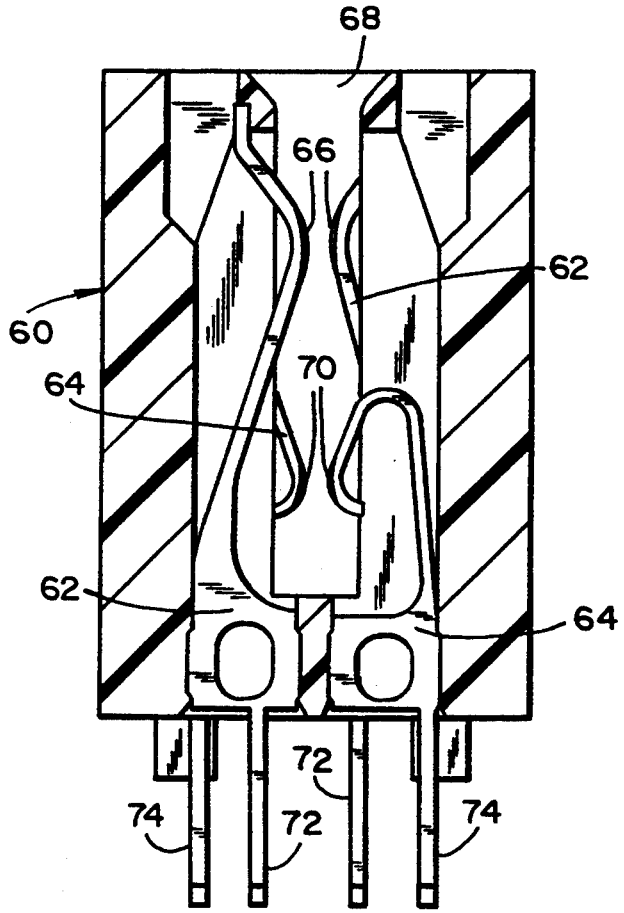
FIG. 2 is a cross sectional view of an alternate embodiment of a card edge connector incorporating features of the present invention.

Referring to FIG. 2, there is shown an alternate embodiment of a connector incorporating features of the present invention. The connector 60 is a bi-level card edge connector, such as an EISA card edge connector. As can be seen, the connector 60 has two types of contacts 62, 64. The first type of contacts 62 have contact areas 66 at a first level in the card edge receiving area 68. The second type of contacts 64 have contact areas 70 at a second lower level in the card edge receiving area 68. The pattern of the solder tails 72 for the contacts 62 and the solder tails 74 for the contacts 64 are the same as the solder tails 32 shown in FIG. 1. The center-to-center spacing between adjacent contacts 62, 64 in each row is preferably 0.025 inch. However, in alternate embodiments, other spacing distances and/or patterns could be used. In other alternate embodiments, other physical attributes of the contacts could be altered including altering the shape of the middle section 34 to other forms of trusses, so long as the middle section 34 is able to accomplish its functions as mentioned above.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A card edge connector comprising:

a housing have a card edge receiving area and two rows of contact receiving channels on opposite sides of the card edge receiving area; and electrical contacts connected to the housing in the contact receiving channels, each contact having a top spring arm, a bottom solder tail, and a middle section therebetween, each of the middle sections having a general ring shape with a center aperture and two opposite sides making an interference fit with the housing in one of the contact receiving channels.

2. A connector as in claim 1 wherein the electrical contacts include at least two types of contacts.

3. A connector as in claim 1 wherein the top spring arms each have an enlarged section at their connections with the middle sections for increased strength.

4. A connector as in claim 1 wherein the top spring arms each have a coined contact surface.

5. A connector as in claim 1 wherein the contacts in each row of contact receiving channels are spaced from adjacent contacts at a center-to-center spacing of about 0.025 inch.

6. A connector as in claim 1 wherein the solder tails extend from a bottom of the housing in a staggered pattern.

7. In a card edge connector having a housing and electrical contacts, each of the contacts having a cantilevered spring arm for contacting an edge of a daughter printed circuit board, a solder tail for contacting a mother printed circuit board, and a middle section between the spring arm and solder tail, the middle section forming an interference fit with the housing, the improvement comprising:

the middle sections of the contacts each having a relatively large electromagnetic reduction aperture in their centers to form a general ring shape, wherein the general ring shape allows the middle section to have sufficient structural rigidity to form the interference fit with the housing and, also reduces the amount of material in the middle section to reduce capacitance between adjacent contacts.

8. A connector as in claim 7 wherein the contacts are spaced from adjacent contacts at a center-to-center spacing of about 0.025 inch.

9. A connector as in claim 7 wherein the solder tails extend from a bottom of the housing in a staggered pattern.

10. A connector as in claim 7 wherein the contacts are comprised of flat sheet metal that is cut to form the contacts.

11. A connector as in claim 10 wherein the spring arms have a coined contact area.

12. A card edge connector comprising:

a housing have a card edge receiving area; and electrical contacts connected to the housing, the contacts having a middle section with two opposite side walls forming an interference fit with the housing and an electromagnetic reduction aperture between the two walls, the middle section having a general structural truss shape to retain structural rigidity between the two walls, but which also allows the aperture to be substantially large.

13. A connector as in claim 12 wherein the structural truss shape comprises a general ring shape.

14. A connector as in claim 12 wherein the contacts are comprised of flat sheet metal that is cut to form the contacts.

15. A connector as in claim 14 wherein the contacts each have a spring arm with a coined contact area.

16. A connector as in claim 12 wherein the contacts are spaced from adjacent contacts at a center-to-center spacing of about 0.025 inch.

* * * * *